US008243057B2

(12) United States Patent
Shin

(10) Patent No.: US 8,243,057 B2
(45) Date of Patent: Aug. 14, 2012

(54) DISPLAY AND DRIVING METHOD THEREOF

(75) Inventor: Dong-Yong Shin, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 609 days.

(21) Appl. No.: 10/819,687

(22) Filed: Apr. 7, 2004

(65) Prior Publication Data

US 2005/0024297 A1 Feb. 3, 2005

(30) Foreign Application Priority Data

Jul. 30, 2003 (KR) ..... 10-2003-0052603

(51) Int. Cl.
*G09G 3/30* (2006.01)

(52) U.S. Cl. ..... 345/213; 345/87; 345/204; 345/79; 345/89; 345/94; 341/144

(58) Field of Classification Search ..... 345/36, 345/76–80, 98, 207, 96, 147; 315/169.1, 315/169.3

See application file for complete search history.

(56) References Cited

U.S. PATENT DOCUMENTS 5,365,284 A * 11/1994 Matsumoto et al. ..... 348/793
5,781,167 A * 7/1998 Rebeschi et al. ..... 345/76
6,333,729 B1 * 12/2001 Ha ..... 345/98
6,924,786 B2 * 8/2005 Hebiguchi ..... 345/103
6,950,081 B2 9/2005 Akimoto et al.
6,970,149 B2 * 11/2005 Chung et al. ..... 345/82
7,006,072 B2 * 2/2006 Ahn ..... 345/103
7,053,870 B2 * 5/2006 Shoji et al. ..... 345/60
7,084,844 B2 * 8/2006 Yeo et al. ..... 345/88
7,154,488 B2 * 12/2006 Morita ..... 345/204
7,369,124 B2 * 5/2008 Nakano et al. ..... 345/204
7,436,376 B2 10/2008 Akimoto et al.
7,468,715 B2 12/2008 Akimoto et al.
2002/0039087 A1 * 4/2002 Inukai ..... 345/76
2003/0090451 A1 * 5/2003 Ahn ..... 345/96
2003/0117362 A1 * 6/2003 An ..... 345/98
2004/0046719 A1 * 3/2004 Wang et al. ..... 345/82
2004/0080503 A1 * 4/2004 Jones et al. ..... 345/211
2004/0104880 A1 * 6/2004 Kang et al. ..... 345/94

(Continued)

FOREIGN PATENT DOCUMENTS

CN 1231463 A 10/1999

(Continued)

OTHER PUBLICATIONS

Patent Abstracts of Japan for Publication No. 2001-060076; Dated Mar. 6, 2001 in the name of Sekiya et al.

(Continued)

*Primary Examiner* — Grant Sitta
(74) *Attorney, Agent, or Firm* — Christie, Parker & Hale, LLP

(57) ABSTRACT

An organic electroluminescent display and driving method thereof. The organic electroluminescent display includes a demultiplexer for outputting signals provided by a data driver to a plurality of data lines according to on/off operation of analog switches. The driving method divides a frame into two parts, and drives them. Data signals are applied to pixels which are not adjacent among the pixels of each row during the former ½ frame, and the data signals are applied to the pixels to which no data signal has been applied in the former ½ frame during the latter ½ frame.

30 Claims, 10 Drawing Sheets

U.S. PATENT DOCUMENTS

| | | | | |
|---|---|---|---|---|
| 2004/0145553 | A1 * | 7/2004 | Sala et al. | 345/87 |
| 2009/0102761 | A1 | 4/2009 | Akimoto et al. | |

FOREIGN PATENT DOCUMENTS

| | | | |
|---|---|---|---|
| CN | 1412854 | A | 4/2003 |
| CN | 1428757 | A | 7/2003 |
| EP | 0 917 128 | A1 | 5/1999 |
| JP | 64-055598 | U | 4/1989 |
| JP | 7-322180 | | 12/1995 |
| JP | 07322180 | A * | 12/1995 |
| JP | 10-319909 | | 12/1998 |
| JP | 2001-060076 | | 3/2001 |
| JP | 2003-005152 | | 1/2003 |
| JP | 2003005152 | A * | 1/2003 |
| JP | 2003-122301 | | 4/2003 |
| JP | 2003-150109 | | 5/2003 |
| JP | 2004-029755 | A | 1/2004 |
| JP | 2004-506924 | | 3/2004 |
| WO | WO 01/31624 | A1 | 5/2001 |

OTHER PUBLICATIONS

Patent Abstract of Japan, Publication No. 07-322180, dated Dec. 8, 1995, in the name of Hideyuki Sugioka et al.

Patent Abstract of Japan, Publication No. 2003-150109, dated May 23, 2003, in the name of Hiroshi Takahara.

* cited by examiner

DISPLAY AND DRIVING METHOD THEREOF

CROSS REFERENCE TO RELATED APPLICATION

This application claims priority to and benefit of Korea Patent Application No. 2003-52603 filed on Jul. 30, 2003 in the Korean Intellectual Property Office, the entire disclosure of which is incorporated herein by reference.

BACKGROUND OF THE INVENTION (a) Field of the Invention

The present invention relates to a display and a driving method thereof. More specifically, the present invention relates to an organic electroluminescent (EL) display and a driving method thereof.

(b) Description of the Related Art

In general, an organic EL display is a display device for electrically exciting fluorescent and organic compounds and emitting light therefrom, and voltage or current drives (M×N) organic emission cells to represent images. An organic emission cell includes an anode (indium tin oxide: ITO), an organic thin film, and a metallic cathode layer. The organic thin film includes an emission layer (EML), an electron transport layer (ETL), a hole transport layer (HTL) for balancing electrons and holes to improve emission efficacy, and additionally includes an electron injection layer (EIL) and a hole injection layer (HIL).

Methods for driving the above-configured organic emission cells include the passive matrix method for allowing anodes and cathodes to cross each other according to an addressing method, selecting a line, and driving the line, and the active matrix method for connecting a thin film transistor (TFT) and a capacitor with each ITO pixel electrode so as to maintain a voltage by a capacitance. The active matrix method includes a voltage programming method and a current programming method according to signal types (a voltage or a current) used by a driving circuit.

An organic EL display comprises an organic EL display panel, a scan driver, and a data driver. The organic EL display panel includes a plurality of data lines for transmitting data signals that represent image signals, a plurality of scan lines for transmitting select signals, and pixel circuits each formed at a pixel area defined by two adjacent scan lines and two adjacent data lines. When the scan driver applies a select signal to a scan line, a transistor is turned on by the select signal, data signals for representing image signals are applied through the data lines to a gate of the transistor from the data driver, and a current flows to an organic EL element through the transistor to emit light.

In order to reduce the number of data driver ICs, demultiplexers or shift registers are used, and a current sample/hold circuit is used when the panel is driven according to the current programming method. It is usual for the current programming method that requires much time of programming data to pixels to use the current sample/hold circuit so as to realize high resolution. However, since the conventional sample/hold circuit uses TFTs as active devices for sampling and holding the current, the available current range is limited because of the TFT characteristics. Also, the sampled current and the held current are different because of the kickback phenomenon that is caused when switching the TFTs, and the output current of the driver IC and the current for driving the data lines become different.

Control the output current of the driver IC is then so as to eliminate the current variation, and hence, a gamma correction process is needed. A deviation of the hold current caused by the deviation of the TFT characteristics is generated during the gamma correction process, and the images may not be uniform.

SUMMARY OF THE INVENTION

In accordance with the present invention an EL display is provided using a demultiplexer based analog switch, and a driving method thereof.

In one aspect of the present invention, a display apparatus includes a display area having first and second data lines for transmitting data signals that represent video signals, a first scan line for transmitting a select signal, a first pixel circuit coupled to the first data line and the first scan line, and a second pixel circuit coupled to the second data line and the first scan line; a data driver for outputting data signals corresponding to the first and second data lines through signal lines; a scan driver for outputting the select signal; and a demultiplexer for transmitting the data signals from the signal lines to the respective first and second data lines. A single frame includes first and second fields. The data signal from the first data line is programmed to the first pixel circuit during a first period of the first field, and the data signal from the second data line is programmed to the second pixel circuit during a second period of the second field.

In another aspect of the present invention, a display apparatus includes a display area having first and second data lines formed in one direction, first and second adjacent scan lines formed to cross the first and second data lines, a first pixel circuit coupled to the first data line and the first scan line, a second pixel circuit coupled to the second data line and the first scan line, a third pixel circuit coupled to the first data line and the second scan line, and a fourth pixel circuit coupled to the second data line and the second scan line; a data driver for outputting data signals corresponding to the first and second data lines through signal lines; and a demultiplexer for transmitting the data signals from the signal lines to the first and second data lines. A single frame includes first and second fields. The first pixel circuit displays images during the first field. The second pixel circuit displays images during the second field. The third pixel circuit displays images during a third field generated by moving the second field for a predetermined time. The fourth pixel circuit displays images during a fourth field generated by moving the first field for a predetermined time.

In still another aspect of the present invention, a display apparatus includes a display area having first and second data lines formed in one direction, first and second adjacent scan lines formed to cross the first and second data lines, a first pixel circuit coupled to the first data line and the first scan line, a second pixel circuit coupled to the second data line and the first scan line, a third pixel circuit coupled to the first data line and the second scan line, and a fourth pixel circuit coupled to the second data line and the second scan line; a data driver for outputting data signals corresponding to the first and second data lines through signal lines; and a demultiplexer for transmitting the data signals from the signal lines to the first and second data lines. A single frame includes first and second fields. The first pixel circuit displays images during the first field. The second pixel circuit displays images during the second field. The third pixel circuit displays images during a third field generated by moving the first field for a predetermined time. The fourth pixel circuit displays images during a fourth field generated by moving the second field for a predetermined time.

In still yet another aspect of the present invention, in a driving method of a display apparatus including a plurality of first data lines, second data lines formed between the adjacent first data lines, first scan lines, second scan lines formed between the adjacent first scan lines, and pixels formed by one of the first and second data lines and one of the first and second scan lines and each having an emission element, the driving method divides the data signals applied through signal lines to the first and second data lines, and applies the divided data signals. A frame is divided into a plurality of fields, and the fields are driven. Data signals are applied to a pixel through the first data line during a first field among the fields, the pixel being formed along the first data line and formed on an area defined by the first scan line and the first data line. Data signals are applied to a pixel through the second data line during a second field among the fields, the pixel being formed along the second data line and formed on an area defined by the first scan line and the second data line.

In a still further aspect of the present invention, a display apparatus includes a plurality of groups formed of a plurality of data lines and scan lines, and pixels coupled to respective data lines and scan lines. The display apparatus includes a data driver for outputting data signals corresponding to the respective data lines of each group through a signal line; and a demultiplexer for transmitting the data signals from the signal line to the data lines. A single frame includes first and second fields. The pixel circuit coupled to a first data line among the data lines and a first scan line among the scan lines in the group displays images during the first field. The pixel circuit coupled to a second data line and the first scan line in the group displays images during the second field. The pixel circuit coupled to a third data line among the data lines and a second scan line in the group displays images during a third field generated by moving the first field for a predetermined time. The pixel circuit coupled to a fourth data line among the data lines except the third data line and the second scan line displays images during a fourth field generated by moving the second field for a predetermined time.

In one embodiment according to the present invention, the third data line is the second data line. In another embodiment, the fourth data line is a data line other than the first and second data lines.

DETAILED DESCRIPTION

Figure 1:
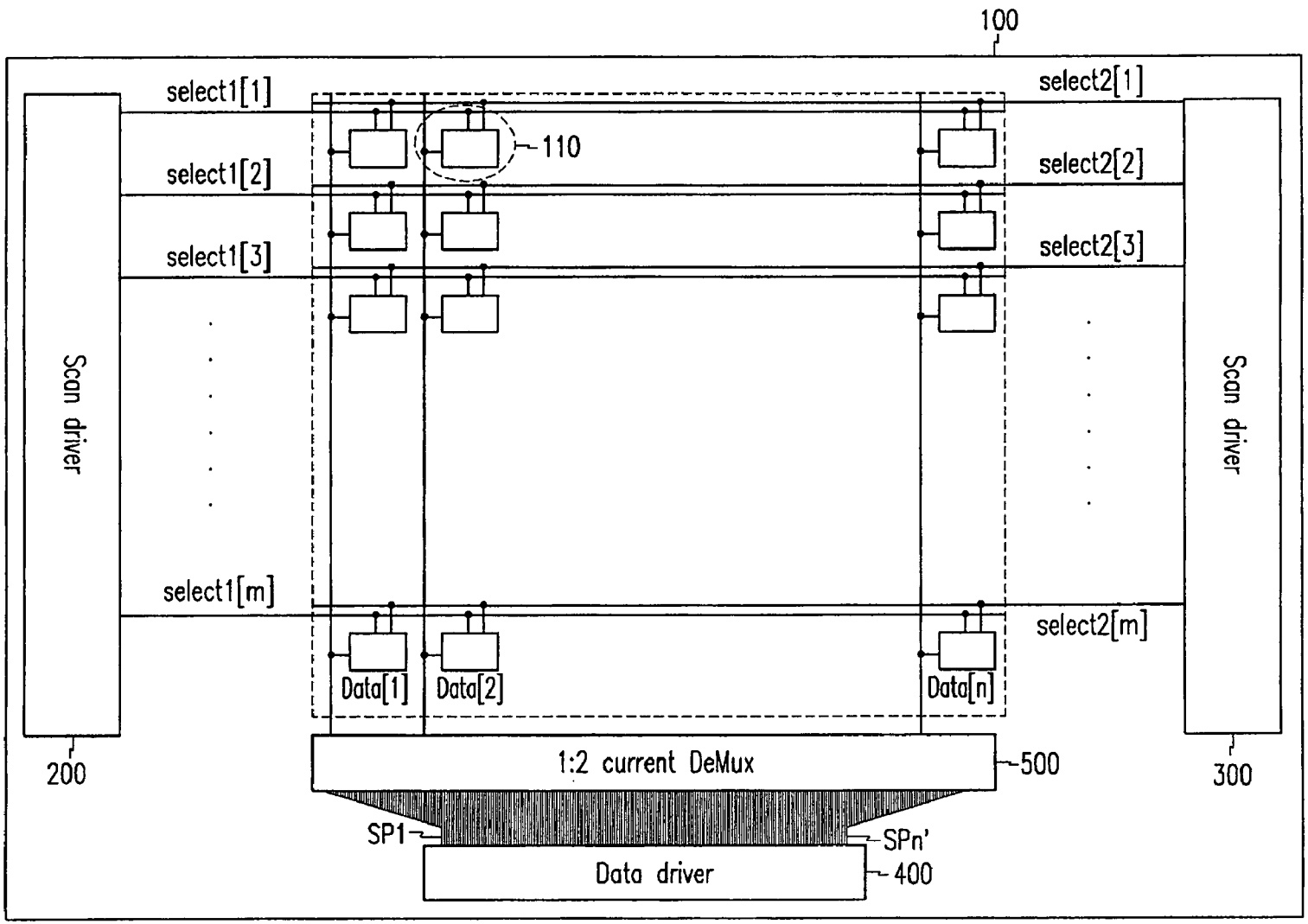
FIG. 1 shows a brief diagram of an organic EL display according to an exemplary embodiment of the present.

FIG. 1 shows a brief diagram of an organic EL display according to an exemplary embodiment of the present invention.

As shown, the organic EL display comprises organic EL display panel 100, scan drivers 200 and 300, data driver 400, and demultiplexer 500.

Organic EL display panel 100 comprises a plurality of data lines Data[1] to Data[n] for transmitting data signals that represent video signals, a plurality of scan lines select1[1] to select1[m] and select2[1] to select2 [m], and a plurality of pixel circuits 110. Data lines Data[1] to Data[n] transmit data signals that represent video signals to pixel circuits 110, scan lines select1[1] to select1[m] transmit select signals for selecting pixel circuits 110 to pixel circuits 110, and scan lines select2[1] to select2 [m] transmit emit signals for emitting light to pixel circuits 110. Pixel circuits 110 are respectively formed at a plurality of pixels surrounded by data lines Data[1] to Data[n] and scan lines select1[1] to select1[m]. Organic EL display panel 100 forms a display area, and scan drivers 200 and 300, data driver 400, and/or demultiplexer 500 can be formed on organic EL display panel 100.

Scan driver 200 sequentially applies select signals to scan lines select1[1] to select1[m], and scan driver 300 sequentially applies emit signals to scan lines select2[1] to select2 [m]. Data driver 400 applies data signals for representing video signals to demultiplexer 500, and demultiplexer 500 has a 1:2 format, and divides the data signals sequentially applied through a single line from data driver 400 into two data lines.

Figure 2:
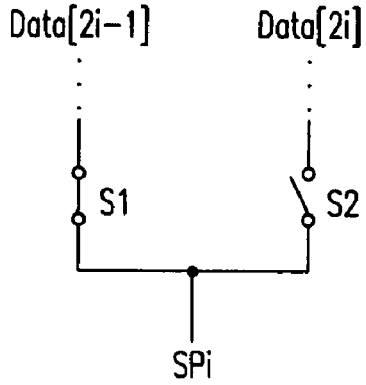
FIG. 2 shows a demultiplexer coupled to a data driver of the organic EL display according to an exemplary embodiment of the present.

FIG. 2 shows a representative portion of demultiplexer 500 coupled to the data driver of the organic EL display according to an exemplary embodiment of the present invention.

Demultiplexer 500 is coupled to data driver 400 through signal lines SP1 to SPn', and transmits the data signals sequentially applied through a single signal line SP1 to SPn' to two data lines Data[2i−1] and Data[2i]. One signal line SP1 to SPn' is coupled to two switches, and the two switches are respectively coupled to a single data line. For example, two switches S1 and S2 are coupled to signal line SPi, and switches S1 and S2 are respectively coupled to data lines Data[2i−1] and Data[2i]. The switches are alternately turned on to transmit the data signal from signal line SPi to respective data lines Data[2i−1] and Data[2i]. Switches S1 and S2 can be formed with NMOS transistors, PMOS transistors, or other similar types of transistors.

Figure 3:
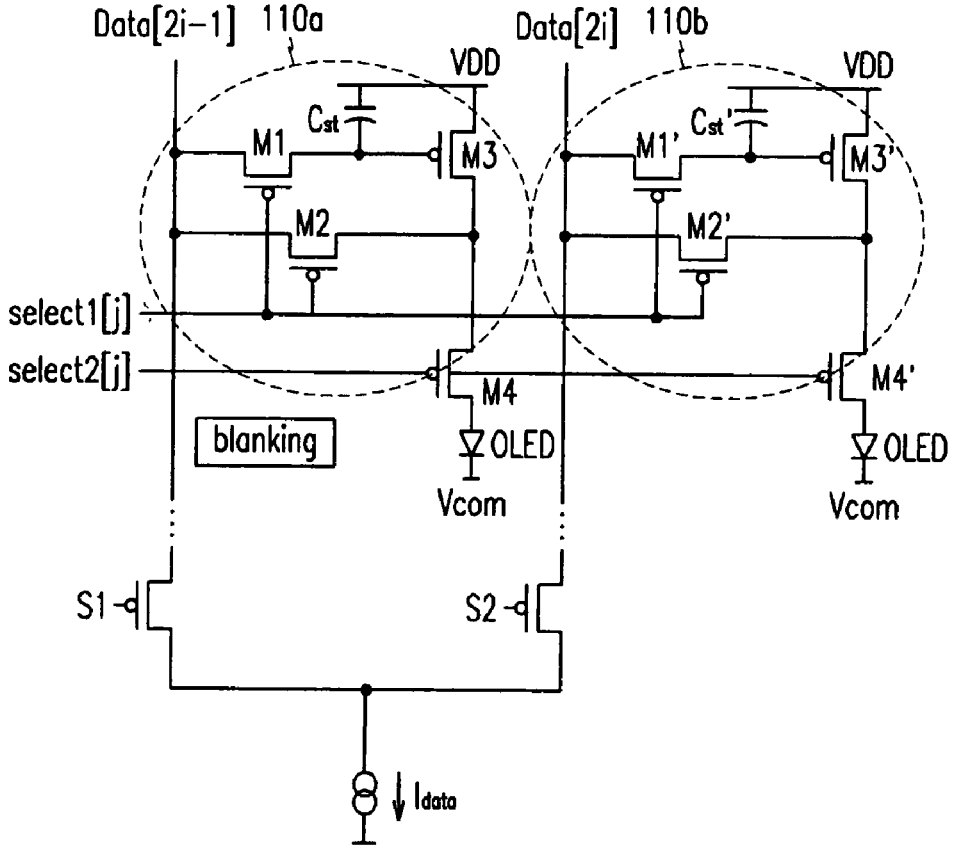
FIG. 3 shows two pixel circuits coupled to the demultiplexer of FIG. 2.

Referring to FIG. 3, a method for driving the organic EL display using demultiplexer 500 according to an exemplary embodiment of the present invention will be described. For ease of description, two pixel circuits 110*a* and 110*b* coupled to $(2i-1)^{th}$ and $2i^{th}$ data lines Data[2i−1] and Data[2i] and a $j^{th}$ scan line select1[j] will be depicted.

Data lines Data[2i−1] and Data[2i] of two pixel circuits 110*a* and 110*b* are coupled to signal line SPi from data driver 400 through switches S1 and S2. Pixel circuit 110*a* comprises four transistors M1 to M4, capacitor Cst, and organic EL element OLED. Pixel circuit 110*b* comprises four transistors M1' to M4', capacitor Cst', and an organic EL element OLED'.

When switch S1 is turned on while transistors M1, M2, M1', and M2' are turned on by the select signal from scan line select1[j], a data signal from signal line SPi is applied to pixel circuit 110*a* through data line Data[2i−1]. Since transistor M3 is diode-connected by turned-on transistors M1 and M2, a voltage corresponding to the data signal from data line Data [2i−1] is programmed to capacitor Cst.

When switch S2 is turned on, the data signal from signal line SPi is applied to pixel circuit 110*b* through data line Data[2i]. The voltage corresponding to the data signal from data line Data[2i] is programmed to capacitor Cst' since transistor M3' is diode-connected by turned-on transistors M1' and M2'. In this instance, since switch S1 is turned off and the current of 0 A is transmitted through data line Data[2i−1], the voltage (a blank signal) corresponding to 0 A is programmed to capacitor Cst.

Therefore, when transistors M4 and M4' are turned on by an emit signal from scan line select2[j] to allow pixel circuits 110*a* and 110*b* to emit light, current of 0 A from pixel circuit 110*a* flows to organic EL element OLED. That is, pixel circuit 110*a* fails to display the original gray and enters into a blank state.

To solve this problem, an additional scan line can be used for pixel circuits 110*a* and 110*b*, but the additional usage of a scan line increases wiring, reduces an aperture ratio, and further needs a scan driver for controlling the added scan line, thereby raising the cost.

To remedy this problem, the method for driving the organic EL display divides a single frame into first and second fields, and drives switches S1 and S2 coupled to signal line SPi so that two adjacent pixels coupled to two data lines Data[2i−1] and Data[2i] to which the data signal output from single signal line SPi is applied may be respectively turned on during the first and second fields. A driving method for the organic EL display according to the exemplary embodiment of the present invention will be described.

FIGS. 4A, 4B, 5A, and 5B show timing diagrams of signals that follow the organic EL display driving method, and pixels that are turned on according to a first exemplary embodiment of the present invention.

Figure 4A:
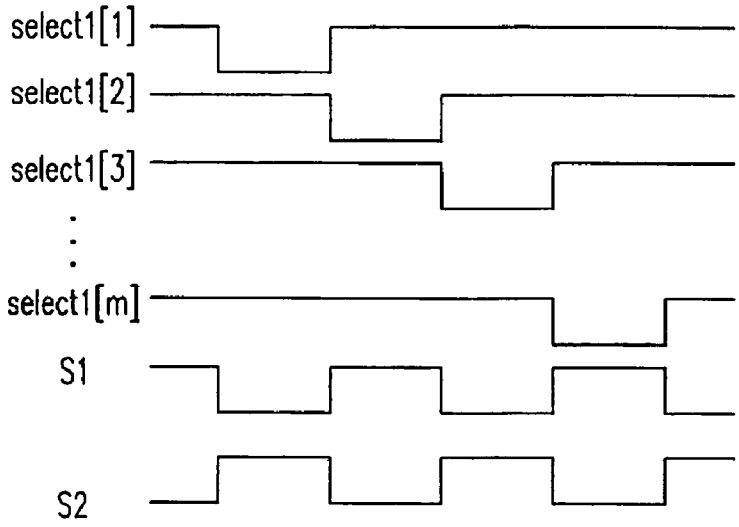
FIGS. 4A, 4B, 5A, and 5B show timing diagrams of signals that follow the organic EL display driving method, and pixels that are turned on according to a first exemplary embodiment of the present invention.
Figure 4B:
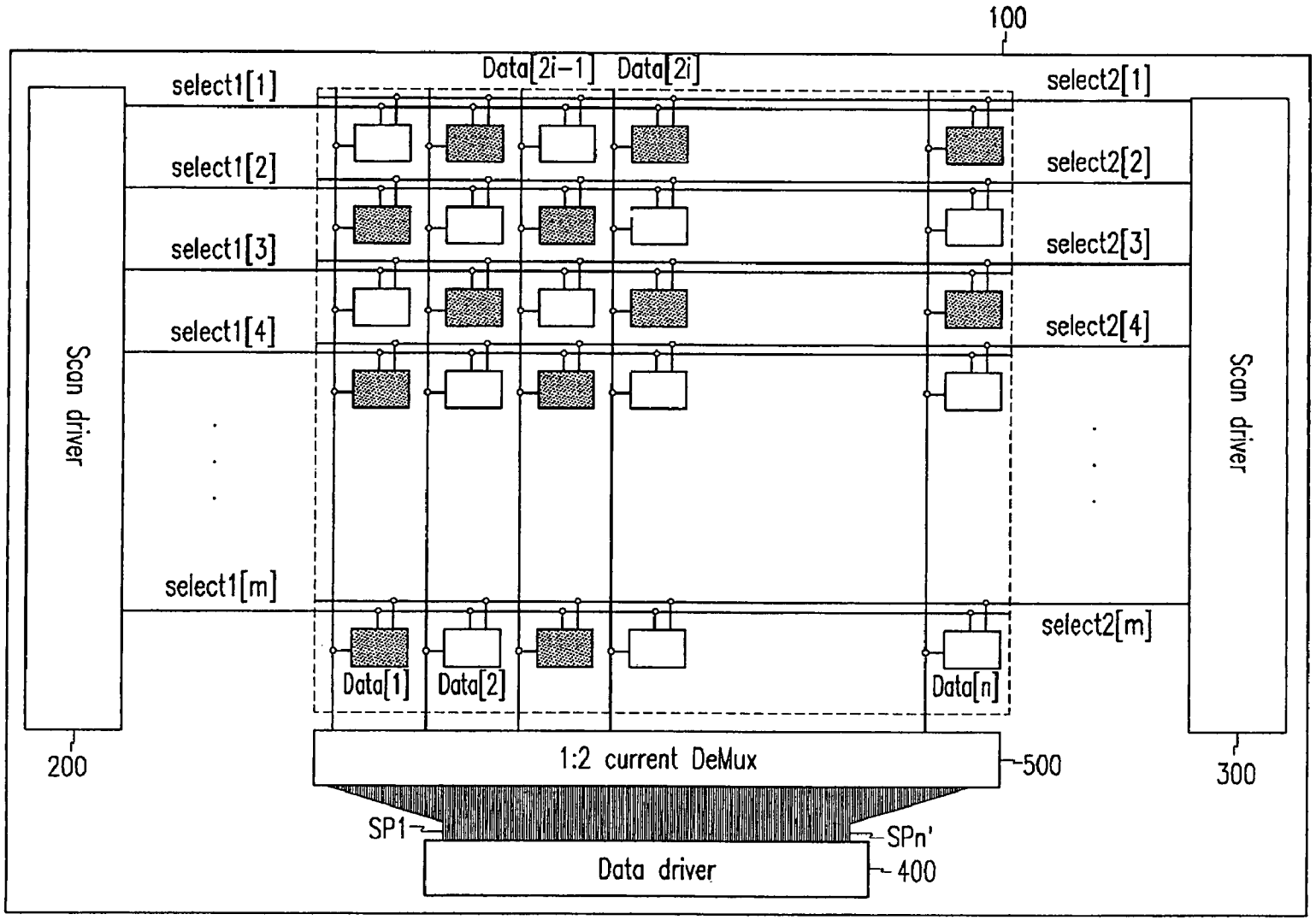

Referring to FIGS. 4A and 4B, switches S1 and S2 are alternately turned on and off during the first field so that the data signal may be alternately applied to two adjacent data lines Data[2i−1] and Data[2i] while the select signal output through scan driver 200 is sequentially applied to respective scan lines select1[1] to select1[m].

That is, when the select signal is applied to scan line select1[1], switch S1 is turned on, and switch S2 is turned off. As a result, the data signal is applied to data line Data[2i−1], and supply of the data signal to data line Data[2i] is intercepted. Therefore, when an emit signal is applied to scan line select2[1], the pixel circuit coupled to scan line select1[1] and data line Data[2i−1] emits light, and the pixel circuit coupled to scan line select1[1] and data line Data[2i] becomes blank and emits no light. It is desirable to apply the emit signal to scan line select2[1] after an enable period of the select signal applied to scan line select1[1] is finished. In another way, it is possible to allow the pixel circuit to emit light when the enable period of the select signal is finished, by eliminating scan lines select2[1] to select2[m] for emit signal transmission, changing transistors M4 and M4' in the pixel circuit of FIG. 3 with NMOS transistors, and driving the NMOS transistors through scan lines select1[1] to select1[m].

Next, when the select signal is applied to scan line select1[2], switch S2 is turned on, and switch S1 is turned off. As a result, the data signal is applied to data line Data[2i], and supply of the data signal to data line Data[2i−1] is intercepted. Therefore, when an emit signal is applied to scan line select2[2], the pixel circuit coupled to scan line select1[2] and data line Data[2i] emits light, and the pixel circuit coupled to scan line select1[2] and data line Data[2i−1] becomes blank and emits no light.

Switches S1 and S2 are alternately turned on/off to sequentially apply a data signal to data lines Data[2i−1] and Data[2i] while a select signal is applied to scan lines select[3] to select[m]. Accordingly as shown in FIG. 4B, the data signal is programmed to the pixel circuit coupled to odd scan line select1[2j−1] and odd data line Data[2i−1] and the pixel circuit coupled to even scan line select1[2j] and even data line Data[2i] in the first field. The pixel circuits to which the data signal is programmed emit light until they become blank by a second field, that is, during a half of the single frame period. Further, the emission period of the pixel circuits can be reduced by controlling the timing of the emit signal.

Figure 5A:
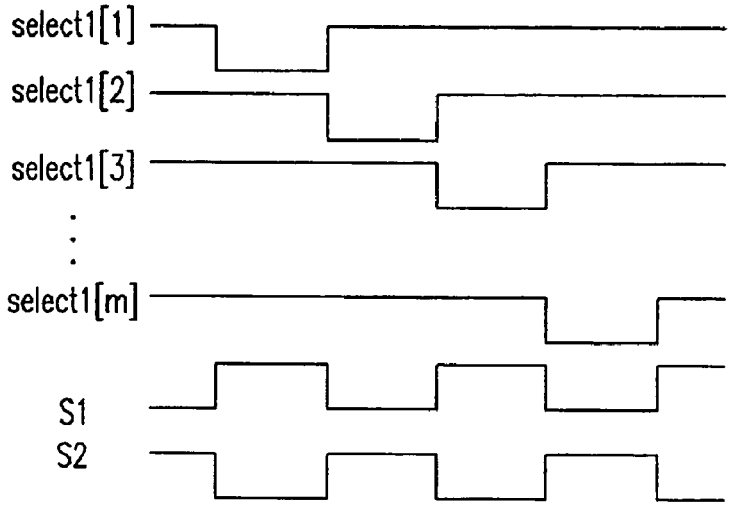
Figure 5B:
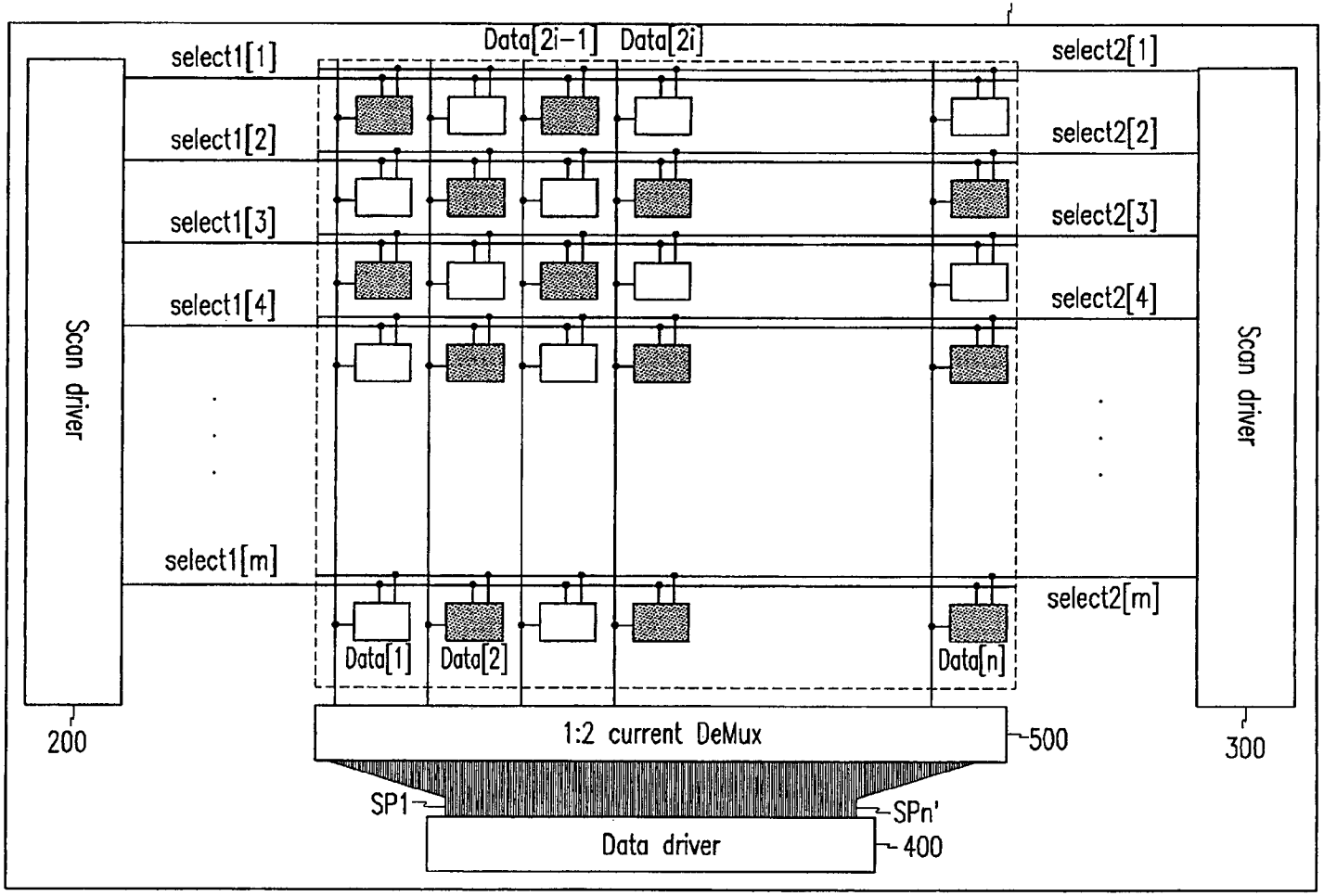

Next, referring to FIGS. 5A and 5B, in the second field, switches S1 and S2 are alternately turned on/off in the opposite manner of the first field case as shown in FIG. 5A so that the data signal may be applied to two adjacent data lines Data[2i−1] and Data[2i] while the select signal output through scan driver 200 is sequentially applied to respective scan lines select1[1] to select1[m].

As shown in FIG. 5A, when a select signal is applied to scan line select1[1], switch S2 is turned on, and switch S1 is turned off. As a result, the data signal is applied to data line Data[2i], and supply of the data signal to data line Data[2i−1] is intercepted. Therefore, when an emit signal is applied to scan line select2[1], the pixel circuit coupled to scan line select1[1] and data line Data[2i] emits light, and the pixel circuit coupled to scan line select1[1] and data line Data[2i−1] becomes blank and emits no light. As described in the operation of the first field, it is desirable to apply the emit signal to scan line select2[1] after an enable period of the select signal applied to scan line select1[1] is finished. In another way, it is possible to allow the pixel circuit to emit light when the enable period of the select signal is finished, by eliminating scan lines select2[1] to select2[m] for emit signal transmission, changing transistors M4 and M4' in the pixel circuit of FIG. 3 with NMOS transistors, and driving the NMOS transistors through scan lines select1[1] to select1[m].

Next, when the select signal is applied to scan line select1[2], switch S1 is turned on, and switch S2 is turned off. As a result, the data signal is applied to data line Data[2i−1], and supply of the data signal to data line Data[2i] is intercepted. Therefore, when an emit signal is applied to scan line select2[2], the pixel circuit coupled to scan line select1[2] and data line Data[2i−1] emits light, and the pixel circuit coupled to scan line select1[2] and data line Data[2i] becomes blank and emits no light.

Switches S1 and S2 are alternately turned on/off to sequentially apply a data signal to data lines Data[2i−1] and Data[2i] while a select signal is applied to scan lines select[3] to select[m]. Accordingly as shown in FIG. 5B, the data signal is programmed to the pixel circuit coupled to odd scan line select1[2j−1] and even data line Data[2i] and the pixel circuit coupled to even scan line select1[2j] and odd data line Data[2i−1] in the second field. The pixel circuits to which the data signal is programmed emit light after they become blank by the first field, that is, during a half the single frame period. Further, the emission period of the pixel circuits can be reduced by controlling the timing of the emit signal.

As described, since the driving method according to the first exemplary embodiment uses the duty driving method for emitting light during the half period of a single frame, the data signal (the current) is doubled compared to the conventional driving methods, thereby solving the problem of the reduced available programming time. Also, the duty driving method according to the first exemplary embodiment improves the flicker phenomenon generated from the conventional duty driving methods since it sequentially emits the odd pixels and the even pixels.

Also, the organic EL display driving method according to the first exemplary embodiment alternately turns on/off switches S1 and S2 so that the data signal may be alternately applied to the two adjacent data lines Data[2i−1] and Data[2i] while the select signal output through scan driver 200 is sequentially applied to respective scan lines select1[1] to select1[m], and in addition, the method can turn on/off switches S1 and S2 so that the data signal may be programmed to the pixel circuit coupled to odd scan line select1[2j−1] and even data line select[2i] and the pixel circuit coupled to even scan line select [2j] and odd data line Data[2i−1] during the first field, and the data signal may be programmed to the pixel circuit coupled to odd scan line select1[2j−1] and odd data line Data[2i−1] and the pixel circuit coupled to even scan line select[2j] and even data line Data[2i] during the second field.

The organic EL display driving method according to the second exemplary embodiment alternately allows the pixel circuit coupled to the odd data line and the pixel circuit coupled to the even data line to emit light respectively during the first and second fields.

FIGS. 6A, 6B, 7A, and 7B show timing diagrams of signals that follow the organic EL display driving method, and pixels that are turned on according to a second exemplary embodiment of the present invention.

Figure 6A:
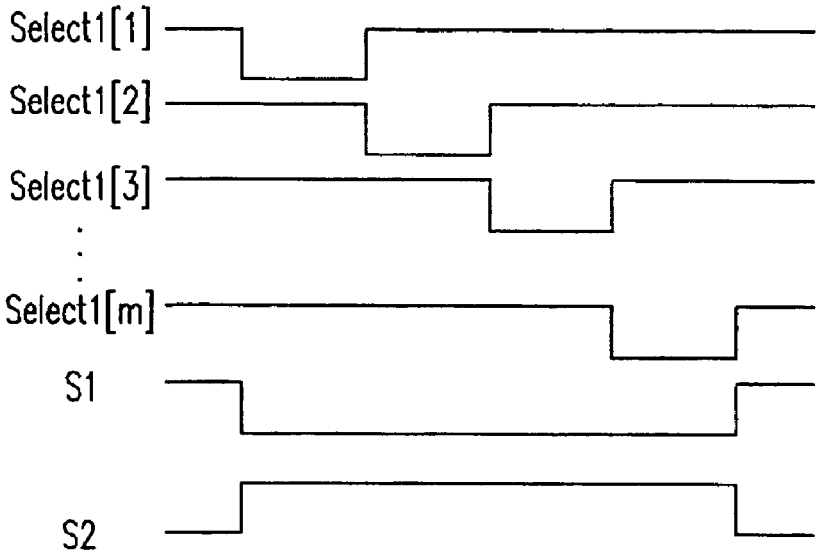
FIGS. 6A, 6B, 7A, and 7B show timing diagrams of signals that follow the organic EL display driving method, and pixels that are turned on according to a first exemplary embodiment of the present invention.
Figure 6B:
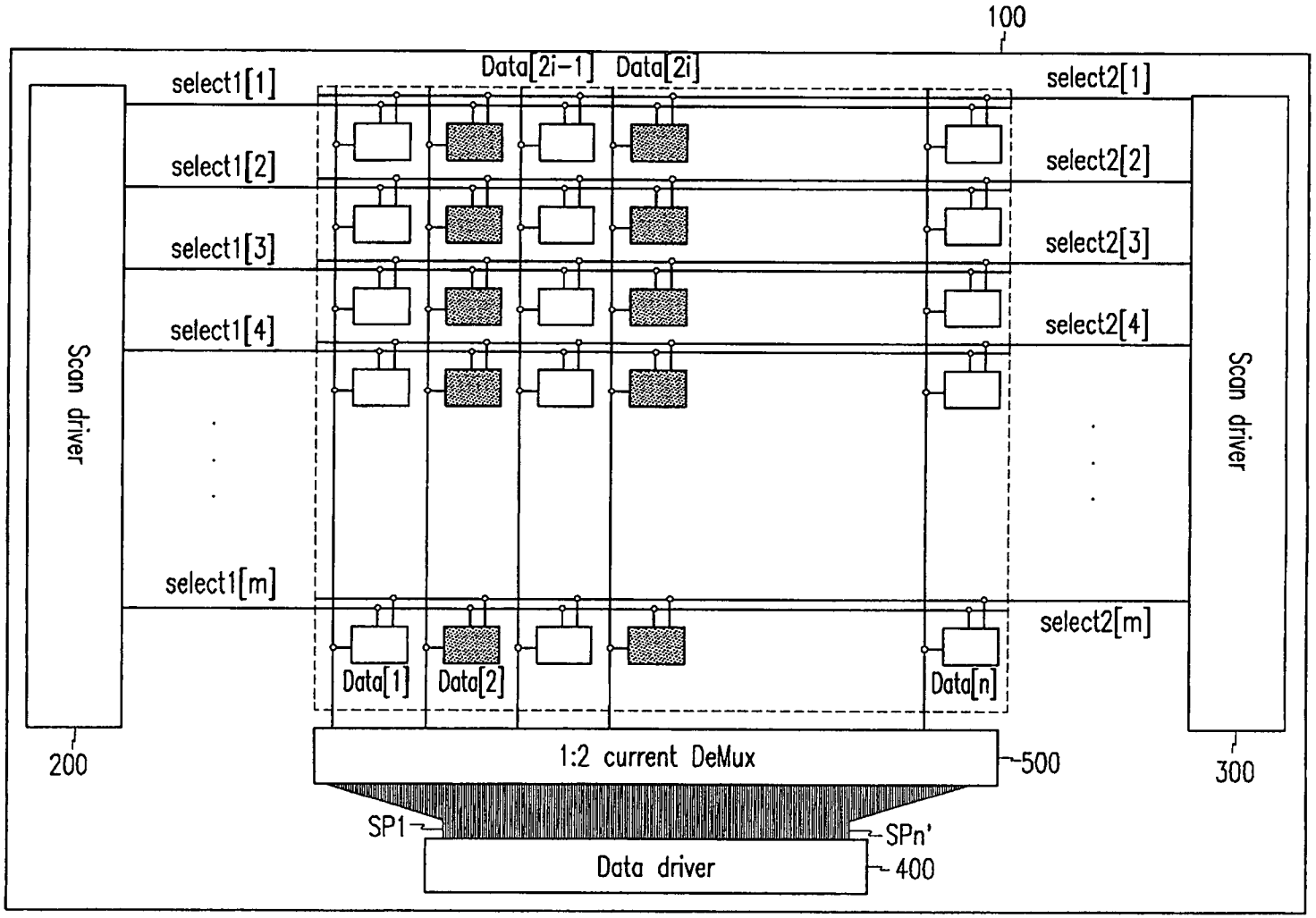

Referring to FIGS. 6A and 6B, switch S1 is turned on and switch S2 is turned off during the first field while the select signal output through scan driver 200 is sequentially applied to respective scan lines select1[1] to select1[m]. As a result, the data signal is applied to data line Data[2i−1], and supply of a data signal to data line Data[2i] is intercepted. Therefore, when the emit signal is sequentially applied to scan lines select2[1] to select2[m], the pixel circuits coupled to scan lines select1[1] to select1[m] and odd data line Data[2i−1] sequentially emit light, and the pixel circuits coupled to scan lines select1[1] to select1[m] and even data line Data[2i] become blank and emit no light as shown in FIG. 6B.

It is desirable to apply the emit signal to scan lines select2[1] to select2[m] when the enable period of the select signal applied to scan lines select1[1] to select1[m] is finished. Further, it is possible to eliminate scan lines select2[1] to select2[m] for transmitting the emit signal, change the transistors M4 and M4' of FIG. 3 with NMOS transistors, drive the NMOS transistors through scan lines select1[1] to select1[m], and thereby allow the pixel circuit to emit light when the enable period of the select signal is finished.

Also, the pixel circuits to which the data signal is programmed emit light until they become blank by the second field described later, that is, during about a half the single frame. Further, the period during which the pixel circuits emit light can be reduced by controlling the timing of the emit signal.

Figure 7A:
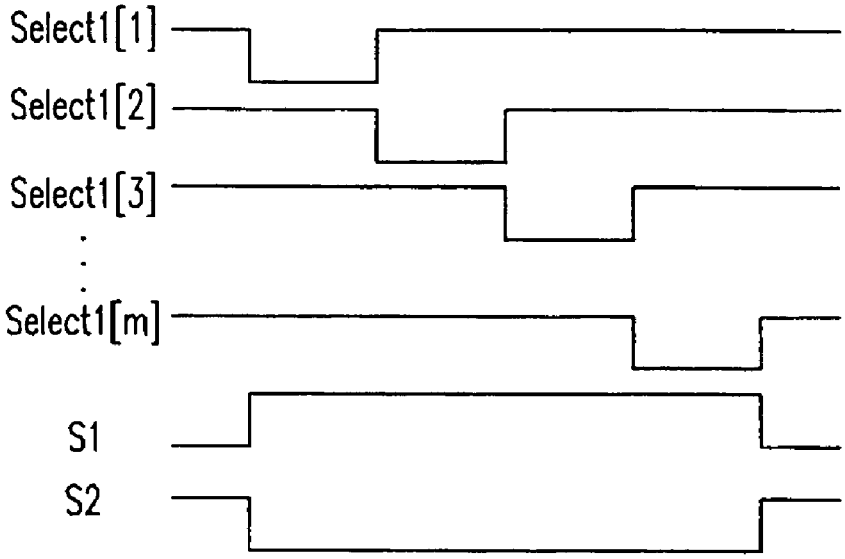
Figure 7B:
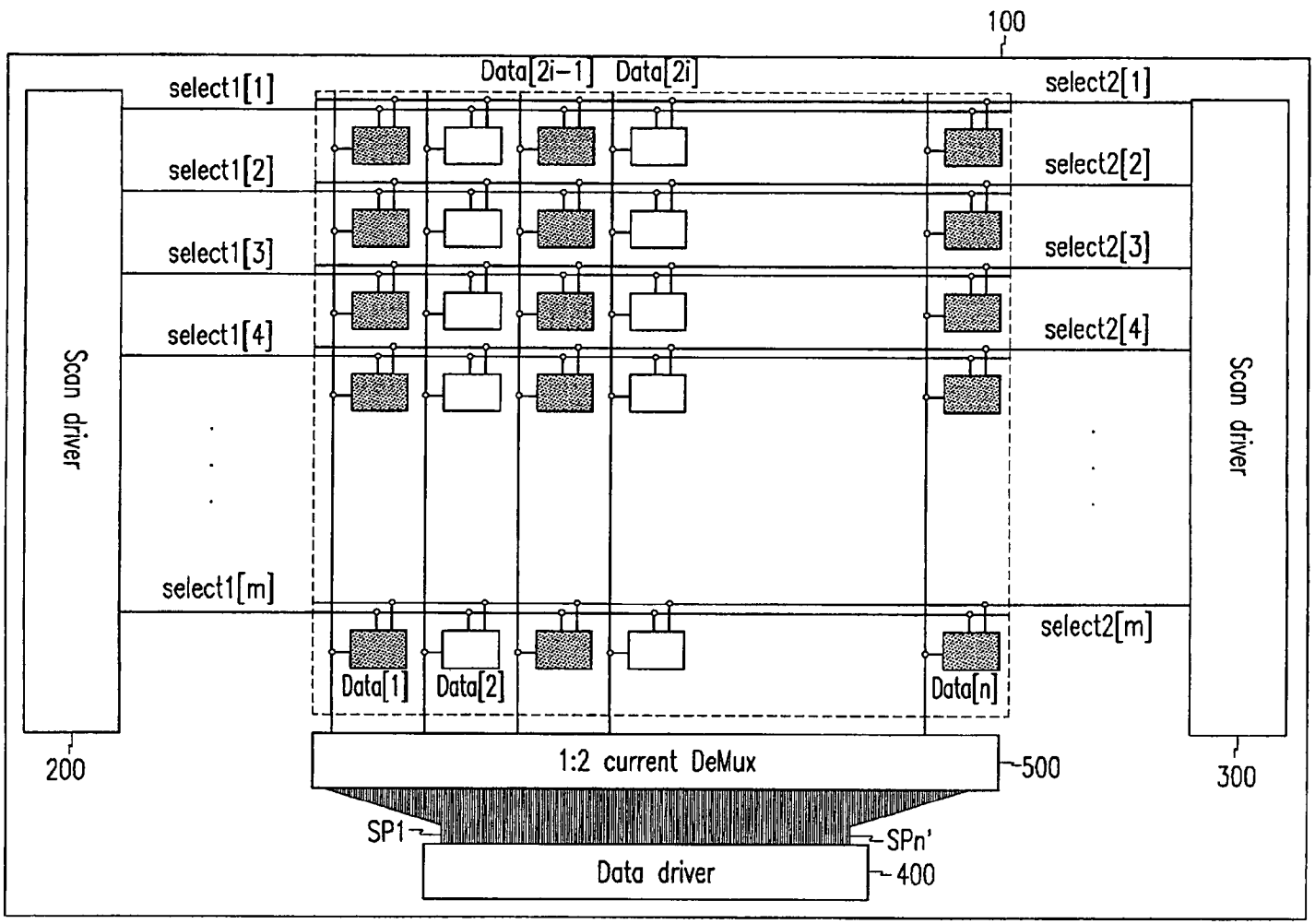

Referring to FIGS. 7A and 7B, switch S1 is turned off and switch S2 is turned on in the second field opposite to the case of the first field while the select signal output through scan driver 200 is sequentially applied to respective scan lines select1[1] to select1[m]. Therefore, when the emit signal is sequentially applied to scan lines select2[1] to select2[m], the pixel circuits coupled to scan lines select1[1] to select1[m] and even data line Data[2i] sequentially emit light, and the pixel circuits coupled to scan lines select1[1] to select1[m] and odd data line Data[2i−1] become blank and emit no light.

It is desirable to apply the emit signal to scan lines select2[1] to select2[m] when the enable period of the select signal applied to select1[1] to select1[m] is finished. Further, it is possible to allow the pixel circuit to emit light when the enable period of the select signal is finished, by eliminating scan lines select2[1] to select2[m] for emit signal transmission, changing the transistors M4 and M4' in the pixel circuit of FIG. 3 with NMOS transistors, and driving the NMOS transistors through scan lines select1[1] to select1[m].

Also, the pixel circuits to which the data signal is programmed emit light after they become blank by the first field, that is, during about a half the single frame period. Further, the emission period of the pixel circuits can be reduced by controlling the timing of the emit signal.

Since the data signal is applied to even data line Data[2i] after it is applied to odd data line Data[2i−1], and the duty driving method is used in the second exemplary embodiment, the time for programming the data signal can be shortened by doubling the data current.

Also, by turning on switch S2 and turning off switch S1 while the select signal output through scan driver 200 is sequentially applied to respective scan lines select1[1] to select1[m] in the first field, and turning on switch S1 and turning off switch S2 in the second field, the organic EL display driving method according to the second exemplary embodiment allows the pixel circuits coupled to scan lines select1[1] to select1[m] and even data line Data[2i] to emit light during the first field, and allows the pixel circuits coupled to scan lines select1[1] to select1[m] and odd data line Data[2i−1] to emit light during the second field.

While this invention has been described in connection with what is presently considered to be exemplary embodiments, it is to be understood that the invention is not limited to the disclosed embodiments, but, on the contrary, is intended to cover various modifications and equivalent arrangements included within the spirit and scope of the appended claims.

For example, a 1:2 demultiplexer is shown in the exemplary embodiments, but the present invention can be applied to 1:N demultiplexers. In the case of using a 1:3 demultiplexer, a single frame would be divided into first to third fields, and three switches (not illustrated) coupled to a signal line SPi would be driven so that three adjacent pixels coupled to three data lines to which the data signal output from single signal line SPi emit light respectively during the first to third fields.

Further, by the driving method according to the first exemplary embodiment, the data signal would be programmed to the pixel circuit coupled to scan line select1[3j−2] and data line Data[3i−2], the pixel circuit coupled to scan line select1[3j−1] and data line Data[3i−1], and the pixel circuit coupled to scan line select1[3j] and data line Data[3i] during the first field, the data signal would be programmed to the pixel circuit coupled to scan line select1[3j−2] and data line Data[3i−1], the pixel circuit coupled to scan line select1[3j−1] and data line Data[3i], and the pixel circuit coupled to scan line select1[3j] and data line Data[3i−2] during the second field, and the data signal would be programmed to the pixel circuit coupled to scan line select1[3j−2] and data line Data[3i], the pixel circuit coupled to scan line select1[3j−1] and data line Data[3i−2], and the pixel circuit coupled to scan line select1[3j] and data line Data[3i−1] during the third field.

Also, by the driving method according to the second exemplary embodiment, the pixel circuits coupled to scan lines select1[1] to select1[m] and data line Data[3i−2] sequentially emit light during the first field, the pixel circuits coupled to scan lines select1[1] to select1[m] and data line Data[3i−1] sequentially emit light during the second field, and the pixel circuits coupled to scan lines select1[1] to select1[m] and data line Data[3i] sequentially emit light during the third field.

As described above, since the current supply is doubled by driving the organic EL display apparatus according to the present invention, the problem of reduced programming time is overcome. In addition, the flicker phenomenon caused by the duty driving is improved by dividing a single frame into a plurality of fields, and the time for programming the data is shortened.

What is claimed is:

1. An active matrix type display apparatus comprising:

a display area including a first data line and a second data line adjacent to the first data line for transmitting data signals that represent video signals, a plurality of scan lines comprising a first scan line for transmitting a select signal, and a plurality of pixel circuits each comprising a first transistor, a storage element coupled between a gate electrode and a second electrode of the first transistor, a second transistor directly coupled between one of the first data line or the second data line and the gate electrode of the first transistor and having a gate electrode coupled to the first scan line, and a third transistor directly coupled between the one of the first data line or the second data line and a third electrode of the first transistor and having a gate electrode coupled to the first scan line, the plurality of pixel circuits including a first pixel circuit having a first storage element and coupled to the first data line and the first scan line, and a second pixel circuit having a second storage element and coupled to the second data line and the first scan line;

a data driver for outputting the data signals to be applied to the first data line and the second data line through a signal line;

a scan driver for outputting the select signal to the plurality of scan lines; and a demultiplexer for transmitting the data signals from the signal line to the first data line and the second data line, respectively, and wherein a frame includes a first field and a second field, wherein the select signal is outputted sequentially to the plurality of scan lines during each of the first field and the second field, and the data signal from the first data line is programmed to the first pixel circuit during a first period of the first field so as to be stored in the first storage element, and the data signal from the second data line is programmed to the second pixel circuit during a second period of the second field so as to be stored in the second storage element, the second period positioned in the second field in a position corresponding to the position of the first period in the first field.

2. A display apparatus comprising:

a display area including a first data line and a second data line adjacent to the first data line for transmitting data signals that represent video signals, a plurality of scan lines comprising a first scan line for transmitting a select signal, and a plurality of pixel circuits each comprising a first transistor, a storage element coupled between a gate electrode and a second electrode of the first transistor, a second transistor directly coupled between one of the first data line or the second data line and the gate electrode of the first transistor and having a gate electrode coupled to the first scan line, and a third transistor directly coupled between the one of the first data line or the second data line and a third electrode of the first transistor and having a gate electrode coupled to the first scan line, the plurality of pixel circuits including a first pixel circuit coupled to the first data line and the first scan line, and a second pixel circuit coupled to the second data line and the first scan line;

a data driver for outputting the data signals to be applied to the first data line and the second data line through a signal line;

a scan driver for outputting the select signal to the plurality of scan lines; and a demultiplexer for transmitting the data signals from the signal line to the first data line and second data line, respectively, and wherein a frame includes a first field and a second field, wherein the select signal is outputted sequentially to the plurality of scan lines during each of the first field and the second field, and the data signal from the first data line is programmed to the first pixel circuit during a first period of the first field, and the data signal from the second data line is programmed to the second pixel circuit during a second period of the second field, wherein the select signal is applied to the first scan line during the first period and the second period, the second period positioned in the second field in a position corresponding to the position of the first period in the first field, and a blank signal is programmed to the second pixel circuit while the data signal from the first data line is programmed to the first pixel circuit during the first period, and the blank signal is programmed to the first pixel circuit while the data signal from the second data line is programmed to the second pixel circuit during the second period.

3. The display apparatus of claim 2, wherein the data signals are current signals, and the data signal applied to the second pixel circuit is intercepted to program the blank signal to the second pixel circuit during the first period, and the data signal applied to the first pixel circuit is intercepted to program the blank signal to the first pixel circuit during the second period.

4. The display apparatus of claim 3, wherein the first pixel circuit and the second pixel circuit each include an emission element corresponding to respectively programmed said data signals, and the emission element of the first pixel circuit emits light during the first field, and the emission element of the second pixel circuit emits light during the second field.

5. The display apparatus of claim 1, wherein the data signal from the first data line is programmed to a third pixel circuit coupled to a second scan line of the plurality of scan lines for receiving the select signal, and the first data line during a third period of the first field, and the data signal from the second data line is programmed to a fourth pixel circuit coupled to the second scan line and the second data line during a fourth period of the second field.

6. The display apparatus of claim 5, wherein a blank signal is programmed to the fourth pixel circuit while the data signal from the first data line is programmed to the third pixel circuit during the third period, and the blank signal is programmed to the third pixel circuit while the data signal from the second data line is programmed to the fourth pixel circuit during the fourth period.

7. The display apparatus of claim 1, wherein the data signal from the first data line is programmed to a third pixel circuit coupled to a second scan line of the plurality of scan lines for receiving the select signal, and the first data line during a third period of the second field, and the data signal from the second data line is programmed to a fourth pixel circuit coupled to the second scan line and the second data line during a fourth period of the first field.

8. The display apparatus of claim 7, wherein a blank signal is programmed to the third pixel circuit while the data signal from the second data line is programmed to the fourth pixel circuit during the first field, and the blank signal is programmed to the fourth pixel circuit while the data signal from the first data line is programmed to the third pixel circuit during the second field.

9. The display apparatus of claim 1, wherein the demultiplexer includes a first switch coupled between the signal line and the first data line, and a second switch coupled between the signal line and the second data line, and the first switch is turned on and the second switch is turned off during the first period, and the second switch is turned on and the first switch is turned off during the second period.

10. The display apparatus of claim 1, wherein the first data line is an odd data line, and the second data line is an even data line.

11. The display apparatus of claim 1, wherein the first data line is an even data line, and the second data line is an odd data line.

12. A display apparatus comprising:

a display area including a first data line and a second data line formed in one direction, the first data line and the second data line being adjacent to each other, a first scan line and a second scan line, the first scan line and the second scan line being adjacent and formed to cross the first data line and the second data line, a first pixel circuit coupled to the first data line and the first scan line, a second pixel circuit coupled to the second data line and the first scan line, a third pixel circuit coupled to the first data line and the second scan line, and a fourth pixel circuit coupled to the second data line and the second scan line;

a data driver for outputting data signals to be applied to the first data line and the second data line through a signal line;

a scan driver for outputting a select signal to the first scan line and the second scan line; and a demultiplexer for transmitting the data signals from the signal line to the first data line and the second data line, wherein a frame includes a first field and a second field, wherein the select signal is outputted sequentially to the first scan line and the second scan line during each of the first field and the second field, and the first pixel circuit displays a first image during the first field, the second pixel circuit displays a second image during the second field, the third pixel circuit displays a third image during a third field that is offset from the second field by a first time period, and the fourth pixel circuit displays a fourth image during a fourth field that is offset from the first field by a second time period, wherein the first field and the second field are non-overlapping in time, the third field and the fourth field are non-overlapping in time, and the first, second, third, and fourth fields have substantially equal durations.

13. The display apparatus of claim 12, wherein the demultiplexer comprises a first switch coupled between the signal line and the first data line, and a second switch coupled between the signal line and the second data line.

14. The display apparatus of claim 12, wherein the first time period and the second time period each include an enable period for the select signal to be outputted to one of the first scan line or the second scan line.

15. The display apparatus of claim 12, wherein the first pixel circuit, the second pixel circuit, the third pixel circuit and the fourth pixel circuit include respective emission elements for emitting light corresponding to respectively programmed said data signals, and the emission elements of the first pixel circuit, the second pixel circuit, the third pixel circuit and the fourth pixel circuit respectively emit light to display the images only during the first field, the second field, the third field and the fourth field, respectively.

16. A display apparatus comprising:

a display area including a first data line and a second data line formed in one direction, the first data line and the second data line being adjacent to each other, a first scan line and a second scan line, the first scan line and the second scan line being adjacent and formed to cross the first data line and the second data line, and a plurality of pixel circuits each comprising a first transistor, a storage element coupled between a gate electrode and a second electrode of the first transistor, a second transistor directly coupled between one of the first data line or the second data line and the gate electrode of the first transistor and having a gate electrode coupled to one of the first scan line or the second scan line, and a third transistor directly coupled between the one of the first data line or the second data line and a third electrode of the first transistor and having a gate electrode coupled to the one of the first scan line or the second scan line, the plurality of pixel circuits including a first pixel circuit coupled to the first data line and the first scan line, a second pixel circuit coupled to the second data line and the first scan line, a third pixel circuit coupled to the first data line and the second scan line, and a fourth pixel circuit coupled to the second data line and the second scan line;

a data driver for outputting data signals to be applied to the first data line and the second data line through a signal line;

a scan driver for outputting a select signal to the first scan line and the second scan line; and a demultiplexer for transmitting the data signals from the signal line to the first data line and the second data line, wherein a frame includes a first field and a second field, wherein the select signal is outputted sequentially to the first scan line and the second scan line during each of the first field and the second field, and the first pixel circuit displays a first image during the first field, the second pixel circuit displays a second image during the second field, the third pixel circuit displays a third image during a third field that is offset from the first field by a first time period, and the fourth pixel circuit displays a fourth image during a fourth field that is offset from the second field by a second time period, wherein the first field and the second field are non-overlapping in time, the third field and the fourth field are non-overlapping in time, and the first, second, third, and fourth fields have substantially equal durations.

17. The display apparatus of claim 16, wherein the demultiplexer comprises a first switch coupled between the signal line and the first data line, and a second switch coupled between the signal line and the second data line.

18. The display apparatus of claim 16, wherein the first time period and the second time period each include an enable period for the select signal to be outputted to one of the first scan line or the second scan line.

19. The display apparatus of claim 16, wherein the first pixel circuit, the second pixel circuit, the third pixel circuit and the fourth pixel circuit include respective emission elements for emitting light corresponding to respectively programmed said data signals, and the emission elements of the first pixel circuit, the second pixel circuit, the third pixel circuit and the fourth pixel circuit respectively emit light to display the images only during the first field, the second field, the third field and the fourth field.

20. A driving method of a display apparatus including a plurality of first data lines, second data lines formed between adjacent said first data lines, first scan lines, second scan lines formed between adjacent said first scan lines, and pixels, each being coupled to one of the first data lines or one of the second data lines and one of the first scan lines or one of the second scan lines and each having an emission element, a first transistor, a storage element coupled between a gate electrode and a second electrode of the first transistor, a second transistor directly coupled between the one of the first data lines or the one of the second data lines and the gate electrode of the first transistor and having a gate electrode coupled to the one of the first scan lines or the one of the second scan lines, and a third transistor directly coupled between the one of the first data lines or the one of the second data lines and a third electrode of the first transistor and having a gate electrode coupled to the one of the first scan lines or the one of the second scan lines, wherein the driving method for dividing data signals applied through a signal line to one of the first data lines and one of the second data lines, and applying the data signals, comprising:

dividing a frame into a plurality of fields;

outputting a select signal sequentially to each of the first scan lines and the second scan lines during each of the plurality of fields;

applying a first data signal demultiplexed from the data signals applied through the signal line, to a first pixel among the pixels through the one of the first data lines during a first field among the fields, the first pixel being formed along the one of the first data lines and formed at an area defined by the one of the first scan lines and the one of the first data lines; and applying a second data signal demultiplexed from the data signals applied through the signal line, to a second pixel among the pixels through the one of the second data lines during a second field among the fields, the second pixel being formed along the one of the second data lines and formed at an area defined by the one of the first scan lines and the one of the second data lines, while applying a blank signal to the first pixel through the one of the first data lines.

21. The driving method of claim 20, wherein the second data signal provided at the second pixel is eliminated while the first data signal is applied through the first data line to the first pixel.

22. The driving method of claim 20, further comprising:

applying a third data signal among the data signals to a third pixel among the pixels through the one of the second data lines during the first field, the third pixel being formed along the one of the second data lines and formed at an area defined by one of the second scan lines and the one of the second data lines; and applying a fourth data signal among the data signals to a fourth pixel among the pixels through the one of the first data lines during the second field, the fourth pixel being formed along the one of the first data lines and formed at an area defined by the one of the second scan lines and the one of the first data lines.

23. The driving method of claim 20, comprising:

applying a third data signal among the data signals to a third pixel among the pixels through the one of the first data lines during the first field, the third pixel being formed along the one of the first data lines and formed at an area defined by the one of the second scan lines and the one of the first data lines; and applying a fourth data signal among the data signals to a fourth pixel among the pixels through the one of the second data lines during the second field, the fourth pixel being formed along the one of the second data lines and formed at an area defined by the one of the second scan lines and the one of the second data lines.

24. The driving method of claim 20, wherein the emission element of one said pixel to which a corresponding said data signal is applied emits light corresponding to the corresponding said data signal for a predetermined period.

25. A display apparatus including a plurality of groups formed of a plurality of data lines and scan lines, and pixel circuits coupled to respective said data lines and said scan lines, each of the pixel circuits comprising a first transistor, a storage element coupled between a gate electrode and a second electrode of the first transistor, a second transistor directly coupled between one of the data lines and the gate electrode of the first transistor and having a gate electrode coupled to one of the scan lines, and a third transistor directly coupled between the one of the data lines and a third electrode of the first transistor and having a gate electrode coupled to the one of the scan lines, wherein the display apparatus further comprises:

a data driver for outputting data signals corresponding to the respective said data lines of each said group through a signal line;

a scan driver for outputting the select signal to the scan lines; and a demultiplexer for transmitting the data signals from the signal line to the data lines, wherein a frame includes a first field and a second field, wherein the select signal is outputted sequentially to the scan lines during each of the first field and the second field, a first pixel circuit among the pixel circuits coupled to a first data line among the data lines and a first scan line among the scan lines in the groups displays a first image during the first field, a second pixel circuit among the pixel circuits coupled to a second data line among the data lines and the first scan line in the groups displays a second image during the second field, wherein the second data line is adjacent to the first data line, a third pixel circuit among the pixel circuits coupled to a third data line among the data lines and a second scan line among the scan lines in the groups displays a third image during a third field that is offset from the first field by a first time period, and a fourth pixel circuit among the pixel circuits coupled to a fourth data line among the data lines except the third data line and the second scan line displays a fourth image during a fourth field that is offset from the second field by a second time period, wherein the first field and the second field are non-overlapping in time, the third field and the fourth field are non-overlapping in time, and the first, second, third, and fourth fields have substantially equal durations.

26. The display apparatus of claim 25, wherein the third data line is the first data line, and the fourth data line is the second data line.

27. The display apparatus of claim 25, wherein the third data line is the second data line.

28. The display apparatus of claim 27, wherein the fourth data line is the first data line.

29. The display apparatus of claim 27, wherein the fourth data line is one of the data lines other than the first and second data lines.

30. The display apparatus of claim 29, wherein the frame further comprises a fifth field, and a fifth pixel circuit among the pixel circuits coupled to the fourth data line and the first scan line displays a fifth image during the fifth field.

* * * * *